United States Patent [19]

Uehara et al.

[11] Patent Number: 5,002,800

[45] Date of Patent: Mar. 26, 1991

[54] PROCESS FOR PRODUCING PHOTOGRAPHIC RESIN-COATED PAPER BY OSCILATING THE DIE OF THE EXTRUDER TO EXTRUDE MOLTEN RESIN, AND APPARATUS FOR THE SAME

[75] Inventors: Hiroshi Uehara, Noda; Tamotsu Miyakozawa, Tokyo, both of Japan

[73] Assignee: Mitsubishi Paper Mills Limited, Tokyo, Japan

[21] Appl. No.: 365,007

[22] Filed: Jun. 12, 1989

[30] Foreign Application Priority Data

Jun. 13, 1988 [JP] Japan ..... 63-146168

[51] Int. Cl.[5] ..... B05D 1/40

[52] U.S. Cl. ..... 427/209; 427/420; 118/323

[58] Field of Search ..... 427/420, 434.2, 439, 427/391, 209; 118/323, 407, 410, 419

[56] References Cited

U.S. PATENT DOCUMENTS

| | | | |
|---|---|---|---|
| 3,274,646 | 9/1966 | Krystof | 425/131.1 X |
| 3,619,311 | 10/1971 | Rose | 118/323 X |
| 4,299,186 | 11/1981 | Pipkin et al. | 118/410 X |
| 4,708,629 | 11/1987 | Kasamatsu | 118/410 X |

*Primary Examiner*—Shrive Beck
*Assistant Examiner*—Alain Bashore
*Attorney, Agent, or Firm*—Cushman, Darby & Cushman

[57] ABSTRACT

A photographic resin-coated paper having no iron hoop-like upheaval can be produced by coating a running paper substrate with a molten resin while oscillating a die of extruder right and left.

8 Claims, 3 Drawing Sheets

PROCESS FOR PRODUCING PHOTOGRAPHIC RESIN-COATED PAPER BY OSCILATING THE DIE OF THE EXTRUDER TO EXTRUDE MOLTEN RESIN, AND APPARATUS FOR THE SAME

BACKGROUND OF THE INVENTION

This invention relates to a process for producing a resin-coated paper used as a photographic support and particularly a resin-coated paper of which coating is made by melt-extrusion of a polyolefin resin, as well as to an apparatus for producing said resin-coated paper.

As the support of photographic printing paper, polyolefin resin-coated paper has been mainly used up to today.

This type of resin-coated paper is produced by the so-called T die extrusion coating process which comprises extrusion-coating a molten resin onto a continuously running paper substrate. Photographic supports produced according to this process range from those having a basis weight of about 70 g/m$^2$ used as printing paper of computer or pringing plate material to those having a basis weight of about 200 g/m$^2$ used as color printing paper, and they are furnished in the form of a roll.

As a problem concerning the quality of rolled product, the phenomenon of "upheaval" on paper surface can be referred to. This phenomenon exercises a particularly marked influence upon resin-coated papers having a basis weight of about 70–150 g/m$^2$, and this phenomenon makes an important trouble to photographic support. The upheaval phenomenon referred to herein is due to the minute defective profile in resin thickness in the direction of width which appears at the time of coating a molten resin. Even if this defect is negligible on a single sheet, the minute difference in thickness is accumulated on a roll, until it produces a so-called "iron hoop-like upheaval" on the circumference of a roll of resin coated paper. If a photographic emulsion is applied to resin-coated paper unrolled from such a roll having such an upheaval, unevenness appears in the emulsion coating and gloss and fogging and the like appear to deteriorate the photographic characteristics due to the difference in pressure, which results in making an important trouble.

Such an upheaval is caused not only by unsatisfactory control of die lip clearance at the time of extruding a resin from extruder, but also by thermal deformation of the lip itself and the minute difference in thickness due to pollution of lip. Even if this minute difference in thickness is under the accuracy of conventional thickness meter, it produces an upheaval on a roll because the slightly thicker parts are concentrically wound at the same position in the axial direction of winding. Although this may be preventable by lessening the length of rolling, such a means greatly lowers the yield of product. Further, if the rolling is carried out at a low tension, a shear in loosely rolled resin-coated paper takes place at the time of rolling, and the shape of resulting roll and resin coated paper surfaces are undesirably damaged.

SUMMARY OF THE INVENTION

This invention provides a process for producing a rolled resin-coated paper by extrusion-coating a molten resin onto a continuously running paper substrate to form a roll of resin-coated paper prevented from the occurrence of upheaval due to the minute thickness difference of profile in the direction of width, as well as an apparatus for producing said rolled resin-coated paper.

This invention provides a process for producing a photographic resin-coated paper, which comprises coating a running paper substrate with a molten resin, while oscillating a die of an extruder for extruding the molten resin in a direction perpendicular to the running direction of the paper substrate.

DESCRIPTION OF THE PREFERRED EMBODIMENTS

Figure 1:
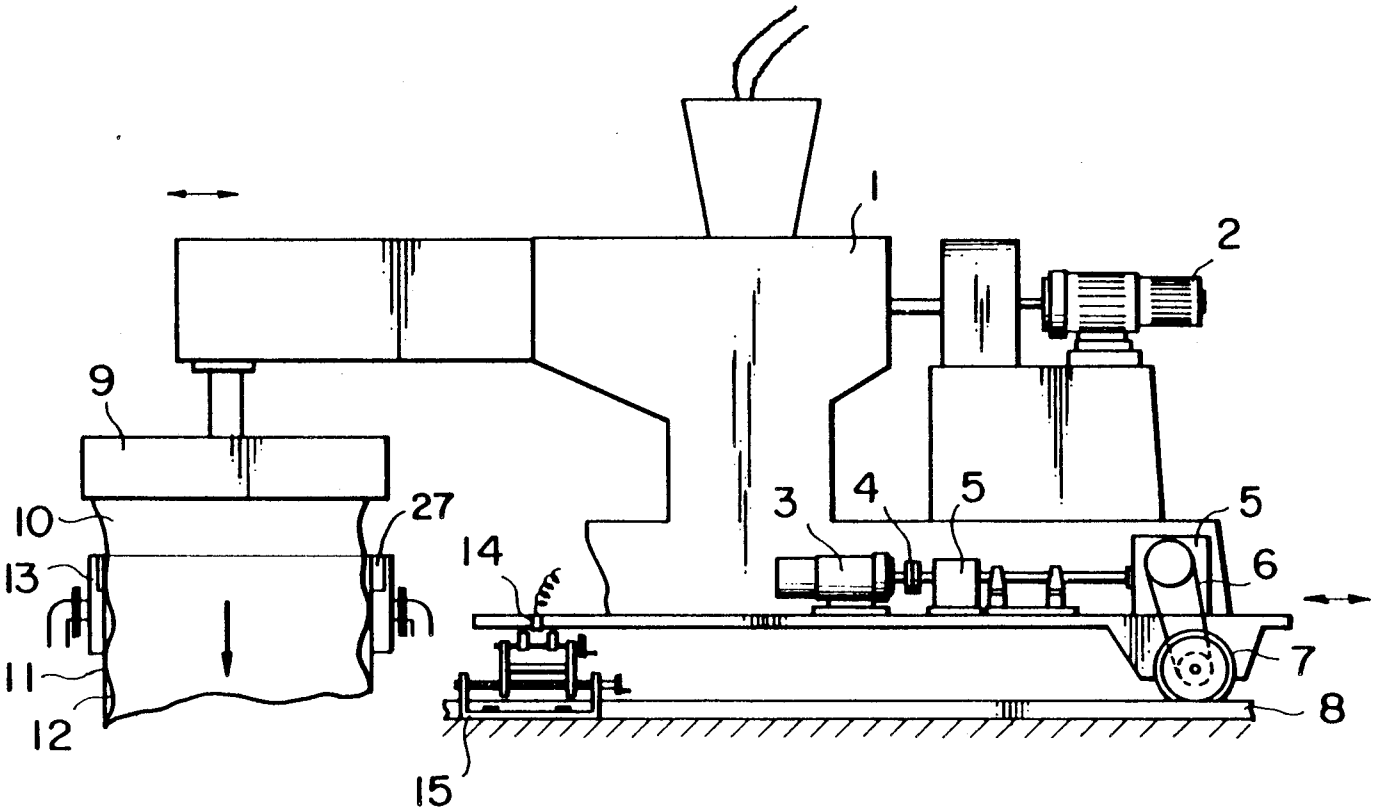
FIG. 1 is an outlined view illustrating an extruder and the coating process of resin onto a paper substrate running on cooling rolls.

This invention relates to a process for preventing the occurrence of the so-called "iron hoop-like upheaval" appearing on a rolled resin-coated paper used as a photographic support which is formed when the minute difference in thickness of profile occurring due to the thermal deformation of die lip, pollution of lip, etc. is accumulated on a constant position with regard to the width direction in the process of producing the roll, as well as to an apparatus for producing the resin-coated paper. The process of this invention comprises producing a resin-coated paper while oscillating a die such as T die, coat-hanger die of a single- or co- extruder for extruding a molten resin in the direction perpendicular to the running direction of paper substrate (i.e. the right-hand and left hand directions on the running paper substrate).

Further, the apparatus of this invention has a mechanism for repeatedly moving an extruder forward and backward in a predetermined span in a predetermined period of time in a direction perpendicular to the production line.

The oscillating speed at which a die of the extruder used in this invention for extruding a resin is oscillated is not critical, but it varies depending on the running speed, basis weight and paper width of the paper substrate. Preferably, however, it is preferable in the range of 20 mm/min. to 60 mm/min. If the oscillating speed is lower than 20 mm/min., the oscillation of extruder brings about no sufficient effect. If the oscillating speed is higher than 60 mm/min., various troubles appear in operation. For example, margin of the extruded resin edge part clings to cooling rolls and back-up rolls due to the rapid change in the margin, and trimming cannot progress smoothly.

As for the range (i.e. width) in which a die of the extruder is oscillated, a broader range is more effective. Under usual conditions of die slip and pollution, however, a range of 10 mm to 30 mm is preferable. If the range is smaller than 10 mm, the effect of this invention cannot be exhibited markedly. If the range exceeds 30 mm, the trimming width increases, due to which productivity is deteriorated.

According to the above-mentioned production process, a rolled resin-coated paper usable as photographic support can be produced without upheaval.

The apparatus of this invention for producing a photographic resin-coated paper has a mechanism for oscillating the whole of extruder and thereby laminating a molten resin extruded from die on a running paper substrate at a constant width in zigzag manner. That is, said mechanism comprises a driving part for forward and backward moving the whole extruder, a speed varying part for controlling the speed of oscillation, an extruder oscillation position presetting part for controlling the molten resin extruded out of the die of extruder so that it can be cast on an appropriate position of running paper, and an oscillation width presetting part for controlling the width of oscillation.

Concrete examples of the apparatus will be illustrated below with reference to the drawings.

FIG. 1 is a schematic illustration of the extruder and the resin-coating process on running paper. In FIG. 1, 1 is main body of extruder, 2 is driving motor for the screw of extruder, 3 is driving motor for moving or oscillating the whole pedestal of extruder, 4 is clutch, 5 is speed varying gear box, 6 is driving force-communicating belt or chain, 7 is wheel of pedestal, 8 is rail, 9 is T die, 10 is molten resin extruded out of die, 11 is running paper substrate, 12 is margin of the extruded resin edge part, 13 is cooling roll, and 14 and 15 are extruder oscillation controlling mechanism.

Figure 2:
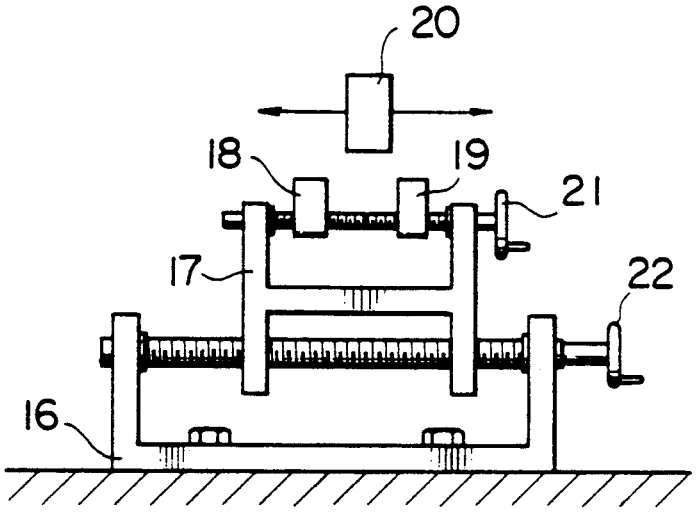
FIG. 2 is an enlarged view of the oscillation-control mechanism (14, 15) of the extruder of FIG. 1.

FIG. 2 is one example of a detailed illustration of oscillation-controlling mechanism 14, 15 of the extruder of FIG. 1. In FIG. 2, 16 is fixing pedestal, 17 is oscillation position presetting stand, 18 is proximity switch of forward movement limit of extruder, 19 is proximity switch of backward movement limit of extruder, 20 is proximity switch fixed on extruder pedestal, 21 is oscillation width (or span) presetting handle, and 22 is oscillation position resetting handle.

The oscillation control in FIGS. 1 and 2 will be explained below. By working the oscillation position presetting handle 22, the center of resin extruded out of extruder is controlled so as to conform with the center of running paper substrate. Next, by working the oscillation width presetting handle 21, the width of the forward-backward oscillation is preset. Then, proximity switch 20 fixed on the pedestal of extruder is set over again at the center of the span between limit proximity switches 18 and 19. The speed of oscillation is preset by means of speed varying gear box 5.

After the above-mentioned presetting works have been completed, oscillation of the extruder can be started. First, the extruder is forward moved at the predetermined speed. When proximity switch 20 fixed on the pedestal of extruder has reached a position just on the extruder forward movement proximity switch 18, clutch 4 becomes off and motor 3 stops, after which it starts a reverse rotation. With the reverse rotation of driving motor, clutch 4 becomes on and a backward movement is started. When the pedestal of extruder moves backward and the proximity switch 20 fixed on the pedestal of extruder has reached a position just on the extruder backward movement limit proximity switch 19, clutch 4 becomes off. Thus, motor 3 stops and again starts a forward motion. Thus, clutch 4 becomes on, and extruder starts a forward movement. Such a series of movement is continuously repeated.

The forward and backward movements of this invention can also be carried out by changing over the gear in the gear box while steadily rotating the driving motor, in stead of changing over the rotation of driving motor "forward-backward"-wise.

Figure 3:
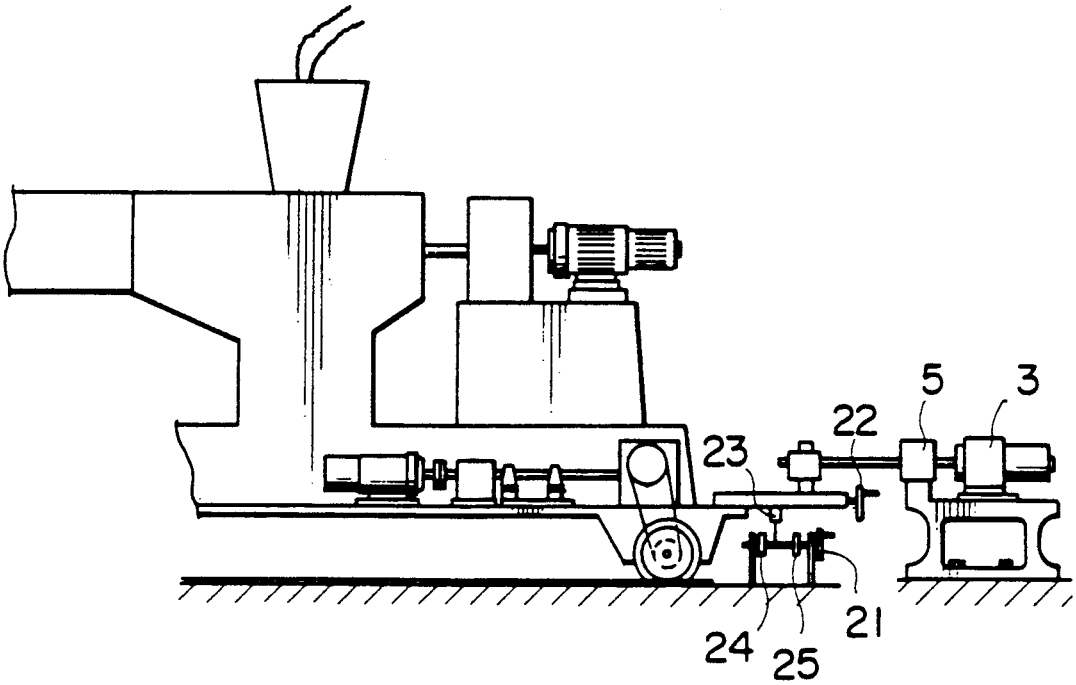
FIG. 3 is an outlined view illustrating another embodiment of the installation of driving part.

The oscillating apparatus of this invention may also be provided as shown in FIG. 3 where its driving part is separately set from the driving motor of which driving part put the pedestal of extruder in the line and out of the line. Further, contact point switch 23 may oscillate with mechanical contact with limits 24 and 25 indicating the width of forward and backward movements of extruder, respectively, as shown in FIG. 3.

The oscillating apparatus of extruder used in this invention may be oscillated by attaching a reducing gear to the motor for driving the extruder. However, air cylinder and the like are also usable, so far as the extruder can be oscillated at a speed ranging from 20 mm/min. to 60 mm/min. in the direction perpendicular to the running paper substrate. The width (or span) of oscillation of extruder can be set by presetting the contrarotation time by means of a timer, or by the limit method allowing contra-movement between preset positions.

Figure 4:
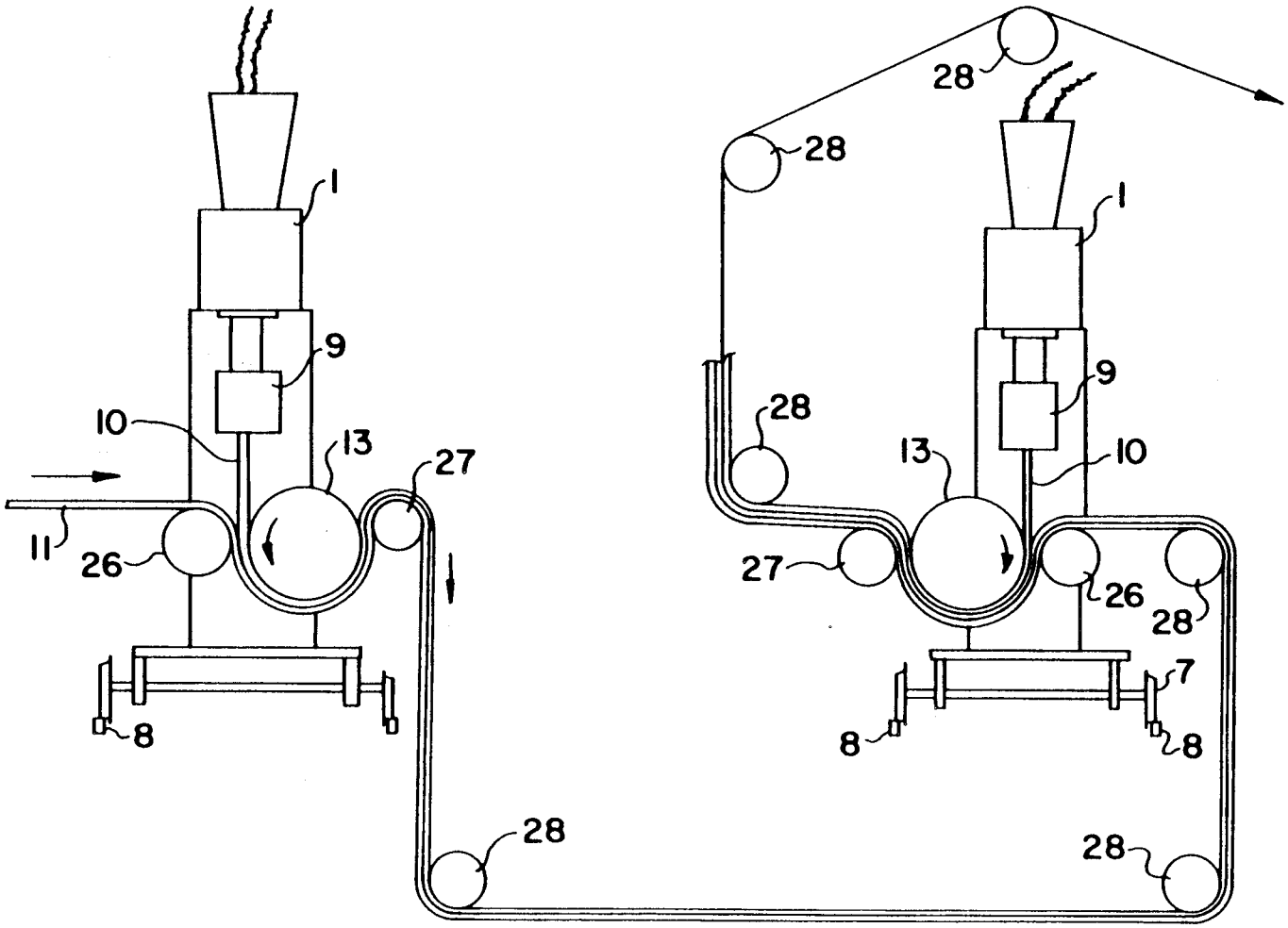
FIG. 4 is an outlined view illustrating an extruder and the coating process of resin onto both sides of a paper substrate, where the first extruding zone involves coating the back surface and the second extruding zone involves coating the front surface. The first extruding zone of FIG. 4 is a perspective view of the embodiment depicted in FIG. 1.

As shown in FIG. 4, it is possible to employ a so-called tandem method wherein in a first extruding zone a rear side of the paper substrate is coated with a resin by using an extruder continuously and in a second extruding zone a front side of the paper substrate is also coated with a resin by using another extruder continuously while changing phases, amplitudes, cycles, etc. of oscillations of individual T dies of both extruders in order to avoid the simultaneous coating of the resins on the same rear and front portions of the paper substrate and to improve the effects of the present invention. The running paper substrate is supported by back-up rolls 26 as the uncoated side of the substrate is coated with resin. The peeling-off roll 27, also depicted in the amended FIG. 1, and the paper roll 28 support the running paper substrate as it passes the cooling roll 13.

The processing speed at the time of resin-coated paper production according to this invention is not critical particularly. The processing speed of resin coating can be varied in the range of 50 m/min. to 200 m/min.

According to the prior art production process of resin-coated paper, a minute difference in the thickness of molten and extruded resin is continuously formed at a constant position, regarding the width direction, on the coating of running paper substrate, so that after rolling the resin-coated paper the slightly thicker parts are accumulated to produce an iron hoop-like upheaval concentrically with regard to the axis of roll. Contrariwise, according to this invention, the extruder is oscillated in a direction perpendicular to the running paper substrate, by which the minute difference in thickness of profile is shifted from time to time by the width of oscillation. Thus, after being formed into a roll, the difference in thickness is dispersed in the width direction instead of being accumulated at one position. Thus, the appearance of upheaval on the rolled product can be eliminated.

As the paper support of the photographic resin-coated paper used in this invention, natural pulp can be used. If desired, synthetic pulp or synthetic fiber may also be used as a mixture with natural pulp or in the form of single material.

Into said support, sizing agent, strengthening agent, fluorescent whitening agent, antistatic agent and the like may be incorporated depending on purposes.

As the resin used in the resin-coated paper of this invention, any of polyolefin, polystyrene, polyvinyl chloride and the like can be used without any particular restriction, so far as it can be coated by melt-extrusion. However, polyolefin resin is particularly effectively usable from the viewpoint of extrusion coating characteristics, adhesiveness to paper substrate and price. As the polyolefin resin used in this invention, olefin homopolymers such as polyethylene, polypropylene, polybutene, polypentene and the like, copolymers of two or more olefins such as ethylenepropylene copolymer and the like, and mixtures thereof can be referred to. A variety of polyolefin resins different in density and melt index (MI) can be used either alone or in the form of a mixture.

Preferably, various additives such as pigments (for example, white pigments such as titanium oxide, zinc oxide, talc, calcium carbonate and the like, metallic salts of aliphatic acids such as zinc stearate, calcium stearate and the like, Ultramarine, Cobalt Violet, etc.), dyes, antioxidants, fluorescent whitening agents, ultraviolet absorbers, etc. may be combined and added to the resin to be used in the melt-extrusion coating process.

The amount of titanium oxide added to the resin layer of emulsion side of resin-coated paper is preferably in the range of 5 to 30% by weight. If its amount is smaller than 5% by weight, hiding power is insufficient as a photographic support. If its amount is larger than 40% by weight, processability is deteriorated. Particularly preferable range of titanium oxide is 7 to 20% by weight.

Although basis weight of paper substrate is not critical, papers having a high surface smoothness are desirable, and the basis weight should be in the range of 50 to 250 g/m$^2$. The effect of this invention is more remarkably exhibited when the basis weight is in the range of 50 to 150 g/m$^2$.

Next, this invention will be explained by way of the following examples. In the examples, all the terms "parts" mean "parts by weight", unless otherwise specified.

EXAMPLES 1-23 AND COMPARATIVE EXAMPLE 1

Back side of a continuously running paper substrate having a basis weight of 100 g/m$^2$ and a width of 1,250 mm at a running speed of 100 m/min was subjected to corona discharge treatment and then coated with a resin composition consisting of 50 parts of a low density polyethylene (density 0.918, MI 5.0) and 50 parts of a high density polyethylene (density 0.965, MI 7.0) at a coating width of 1,280 mm and a coating thickness of 20 microns by melt-extrusion using a T die melt-extruder having a diameter of 115 mm. Thus, a backing resin-layer was formed. Subsequently, in the second zone, front surface of the paper was subjected to corona discharge treatment and then coated with a resin composition consisting of 40 parts of a master batch prepared by kneading 30% by weight of titanium oxide into a low density polyethylene (density 0.918, MI 8.5), 45 parts of a low density polyethylene (density 0.918, MI 5.0) and 25 parts of a high density polyethylene (density 0.965, MI 7.0) at a coating width of 1,275 mm and a coating thickness of 20 microns by T die melt-extrusion using a melt-extruder having a diameter of 115 mm. Thus, a front side resin layer was formed. Thereafter, both the margins of the extruded resin edge parts were trimmed by means of a slitter to adjust the width to 1,230 mm, after which the paper was wound by means of a wind-up machine to prepare a rolled product of 3,000 m, as a resin-coated paper usable as photographic support. On the other hand, as an example of this invention, a resin-coated paper shown in Table 1 was produced by the use of an oscillating apparatus prepared by attaching a motor oscillating in a direction perpendicular to the running paper substrate to a T die melt-extruder having a diameter of 115 mm, at varied speed and width of oscillation.

In this case, it is possible that both sides of paper substrate are coated with the resin continously by a so-called tandem method while controlling the oscillation of a T die of an extruder for coating the resin on a rear side and that of a T die of an extruder for coating the resin on a front side so as to make the phases of oscillation shift in $\frac{1}{8}$ cycle with regard to the paper substrate.

Each of the resin-coated paper thus produced was formed into a 3,000 m roll, and the uppermost part of roll was rubbed with a carbon paper in order to evaluate the extent of upheaval, and the state of iron hoop-like upheaval was observed. Further, while oscillating the extruder, general workability, i.e actual easiness of operation, stability at the time of production and easiness to maintain, were evaluated. The results are summarized in Table 1.

It is apparent from Table 1 that, by the oscillation, the upheaval in the form of roll can be prevented and this effect can be effectively exhibited in the oscillation speed range of 20 mm/min. to 60 mm/min. and in the oscillation width range of 20 mm to 30 mm.

TABLE 1

| Example No. | With/Without oscillation | Speed of oscillation | Width of oscillation | Extent of upheaval | Operating characteristic |
|---|---|---|---|---|---|
| Comparative Example 1 | Without | — | — | X | ○ |
| Example | | | | | |
| 1 | With | 5 | 5 | ✱ | ○ |
| 2 | " | " | 10 | ✱ | ○ |
| 3 | " | 10 | 5 | ✱ | ○ |
| 4 | " | " | 10 | ✱ | ○ |
| 5 | " | " | 20 | ✱ | ○ |
| 6 | " | " | 30 | ✱ | △ |
| 7 | " | 20 | 5 | ✱ | ○ |
| 8 | " | " | 10 | △ | ○ |
| 9 | " | " | 20 | ○ | ○ |
| 10 | " | " | 30 | ◎ | ○ |
| 11 | " | " | 40 | ◎ | ✱ |

TABLE 1-continued

| Example No. | With/Without oscillation | Speed of oscillation | Width of oscillation | Extent of upheaval | Operating characteristic |
|---|---|---|---|---|---|
| 12 | " | 40 | 5 | Δ | ○ |
| 13 | " | " | 10 | ◎ | ○ |
| 14 | " | " | 20 | ◎ | ○ |
| 15 | " | " | 30 | ◎ | ○ |
| 16 | With | 40 | 40 | ◎ | Δ |
| 17 | " | 60 | 5 | Δ | ○ |
| 18 | " | " | 10 | ◎ | ○ |
| 19 | " | " | 20 | ◎ | ○ |
| 20 | " | " | 30 | ◎ | ○ |
| 21 | " | " | 40 | ◎ | Δ |
| 22 | " | 70 | 10 | ◎ | Δ |
| 23 | " | " | 30 | ◎ | Δ |

: Very good,
: Good,
Δ: Rather good.
: Rather bad (with some noticeable improvement).
X: Bad

What is claimed is:

1. A process for producing a photographic resin-coated paper, which comprises coating a running paper substrate with a molten resin by casting the molten resin directly onto the continuously running paper substrate, while oscillating a die of an extruder for extruding the molten resin in a direction perpendicular to the running direction of the paper substrate.

2. A process according to claim 1, wherein the die of the extruder is oscillated at a speed of 20 to 60 mm/min.

3. A process according to claim 1, wherein the die of the extruder is oscillated in the width of 10 to 30 mm/min.

4. A process according to claim 1, wherein the resin is a polyolefin.

5. A process according to claim 1, wherein the die of the extruder is a T die.

6. A process according to claim 1, wherein the coating of the molten resin is carried out by coating the resin continuously on a rear side of the paper substrate using an extruder and coating the resin continuously on a front side of the paper substrate using another extruder, while changing phases, amplitudes and/or cycles of oscillations of individual dies of both extruders in order to avoid simultaneous coating of the resins on the same rear and front portions of the paper substrate.

7. An apparatus for producing a photographic resin-coated paper by coating a molten resin extruded out of a die onto a running paper at a constant width "zigzag"-wise, which comprises a driving part for repeatedly oscillating the whole of extruder forward and backward, a speed-varying part for controlling the speed of oscillation, an extruder oscillation position presetting part for controlling the molten resin extruded out of the die of extruder so that it can be cast at an appropriate position of running paper, and an oscillation width presetting part for controlling the width of oscillation.

8. An apparatus according to claim 7, wherein the die is a T die.

* * * * *